US011827432B2

(12) United States Patent
Pugh

(10) Patent No.: US 11,827,432 B2
(45) Date of Patent: Nov. 28, 2023

(54) PIZZA BOX BLANK AND ARRANGEMENT THEREOF

(71) Applicant: Smart Packaging, LLC, Plymouth, MN (US)

(72) Inventor: Jeffrey D. Pugh, Minnetonka, MN (US)

(73) Assignee: Smart Packaging, LLC, Plymouth, MN (US)

( * ) Notice: Subject to any disclaimer, the term of this patent is extended or adjusted under 35 U.S.C. 154(b) by 0 days.

(21) Appl. No.: 17/207,262

(22) Filed: Mar. 19, 2021

(65) Prior Publication Data

US 2021/0292044 A1 Sep. 23, 2021

Related U.S. Application Data

(60) Provisional application No. 62/992,892, filed on Mar. 20, 2020.

(51) Int. Cl.
*B65D 5/66* (2006.01)
*B65D 5/42* (2006.01)

(52) U.S. Cl.
CPC ..... *B65D 5/6652* (2013.01); *B65D 5/4266* (2013.01); *B65D 2585/366* (2013.01)

(58) Field of Classification Search
CPC ..... B65D 2585/366; B65D 5/4266; B65D 5/6652; B65D 5/6661; B65D 5/6664; B65D 5/2057; B65D 2301/10; B65D 5/6655; B65D 5/6658
USPC .... 229/100, 152, 906, 195, 149, 198.2, 147, 229/153, 154, 155, 918, 902, 936; 206/557
See application file for complete search history.

(56) References Cited

U.S. PATENT DOCUMENTS 4,265,393 A * 5/1981 Orchard ..... B65D 5/6652 229/160
4,765,534 A * 8/1988 Zion ..... B65D 5/6655 229/196
5,118,032 A * 6/1992 Geho ..... B65D 5/6664 229/110
5,381,949 A * 1/1995 Correll ..... B65D 5/302 229/148
5,553,771 A * 9/1996 Correll ..... B65D 5/302 229/110
6,092,715 A * 7/2000 Correll ..... B65D 5/2033 229/152
6,270,008 B1 * 8/2001 Kouyoumdjian .... B65D 5/2057 229/152
6,922,976 B2 * 8/2005 Correll ..... B65D 5/665 53/484

(Continued)

FOREIGN PATENT DOCUMENTS

EP 1331170 A1 * 7/2003 ..... B65D 5/2033

*Primary Examiner* — Christopher R Demeree
(74) *Attorney, Agent, or Firm* — Todd R. Fronek; Larkin Hoffman Daly & Lindgren, Ltd

(57) ABSTRACT

A pizza box blank includes a bottom panel, a top panel and a rear wall connecting the bottom panel to the top panel. The bottom panel includes first and second side walls. The blank includes first and second flaps connected to the first and second side walls, respectively, wherein upon assembly of the blank into a pizza box, the first and second flaps are positioned adjacent the top panel and extend toward one another.

18 Claims, 4 Drawing Sheets

(56) References Cited

U.S. PATENT DOCUMENTS

| | | | | |
|---|---|---|---|---|
| 8,459,536 | B2 * | 6/2013 | Hanna | B65D 5/22<br>229/128 |
| 2005/0103832 | A1 * | 5/2005 | Correll | B65D 5/6664<br>229/110 |
| 2021/0292044 | A1 * | 9/2021 | Pugh | B65D 5/4266 |

* cited by examiner

PIZZA BOX BLANK AND ARRANGEMENT THEREOF

BACKGROUND

Current pizza delivery boxes are manufactured in various configurations.

SUMMARY

A pizza box blank includes a bottom panel, a top panel and a rear wall connecting the bottom panel to the top panel. The bottom panel includes first and second side walls. The blank includes first and second flaps connected to the first and second side walls, respectively, wherein upon assembly of the blank into a pizza box, the first and second flaps are positioned adjacent the top panel and extend toward one another.

DESCRIPTION

Figure 1:
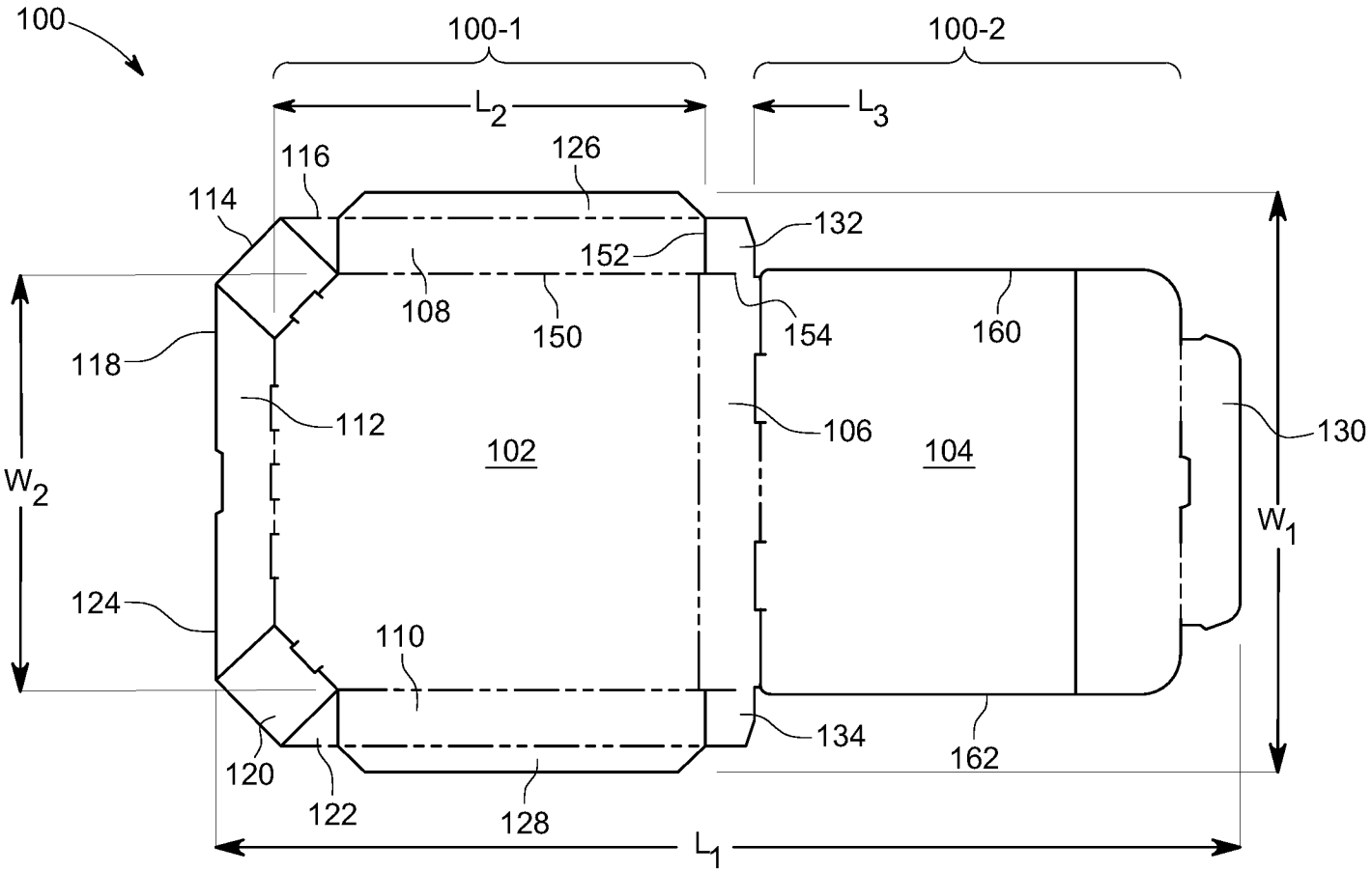
FIG. 1 is a top plan view of a first embodiment of an example pizza box blank.

FIG. 1 is a top plan view of an embodiment of a pizza box blank 100 defining a bottom panel 102, a top panel 104 and a rear wall 106 connecting the bottom panel 102 and the top panel 104. The rear wall 106 separates the blank into a bottom side 100-1 and a top side 100-2, such that all structures on the bottom side 100-1 (i.e., including bottom panel 102 and structures connected thereto) are on one side of the rear wall 106 and all structures on the top side 100-2 (i.e., including top panel 104 and structures connected thereto) are on the opposite side of rear wall 106. Connected with the bottom panel 102 are opposed side walls 108 and 110, as well as front wall 112. A first corner wall 114 is connected to side wall 108 through a triangular connecting panel 116 and is connected to front wall 112 through a triangular connecting panel 118. Similarly, a second corner wall 120 is connected to side wall 110 through a triangular connecting panel 122 and is connected to front wall 112 through a triangular connecting panel 124. A first side flap 126 is connected to side wall 108 and a second side flap 128 is connected to side wall 110. Connected with the top panel 104 is a closure tab 130. In addition, opposed side flaps 132 and 134 are connected on either side of the rear wall 106.

Blank 100 can be formed of corrugated cardboard structure having an inner liner, an outer liner and a fluting medium (e.g., an A flute, B flute, E flute). To form the various structures of blank 100 (i.e., the panels, walls, flaps and tab), the corrugated cardboard structure can be cut and/or creased in selected positions to form the structures as desired. In one embodiment, cuts are evenly spaced along a line that delineates these structures. For example, a line 150 separating bottom panel 102 and side wall 108 can be formed by cutting a sequential pattern of ½ inch through a thickness of the blank 100 followed by a ¼ inch crease (i.e., no cut) along a length of the line 150. Other lines can be similarly formed, or lengths of cut portions or crease portions can be adjusted accordingly. To form other structures, such as flap 132, a line 152 is cut through an entirety of the thickness of blank 100 such that flap 132 is disconnected from side wall 108 and is creased along a line 154 such that flap 132 can be folded with respect to rear wall 106.

Blank 100 can transition from an unassembled state (as illustrated) into an assembled state, forming a pizza box. Transition to the assembled state can be made by folding top panel 104 toward bottom panel 102. Additionally, side flap 132 can be positioned adjacent side wall 108 closer to bottom panel 102 and side flap 134 is positioned adjacent side wall 110 closer to bottom panel 102. Each of the side walls 108 and 110 are folded inwardly, causing front wall 112 to be folded inwardly due to connection of front wall 112 with side walls 108 and 110 through corner walls 114 and 120, respectively. Closure tab 130 can be inserted adjacent front wall 112, the closure tab 130 being positioned between wall 112 and bottom panel 102. When folded into a pizza box, dimension $L_2$ becomes an overall length of the pizza box, dimension $W_2$ becomes an overall width of the pizza box and dimension $L_3$ becomes an overall height of the pizza box.

In the embodiment illustrated, a maximum width of top panel 104 extends from a first side edge 160 to a second side edge 162. Each of the edges 160, 162 are free from connection to other structures such as walls, panels and the like, such that the maximum width of top panel 104, as well as all structures on the top side 100-2 is equal to the overall width $W_2$ of the pizza box in the assembled state.

Figure 2:
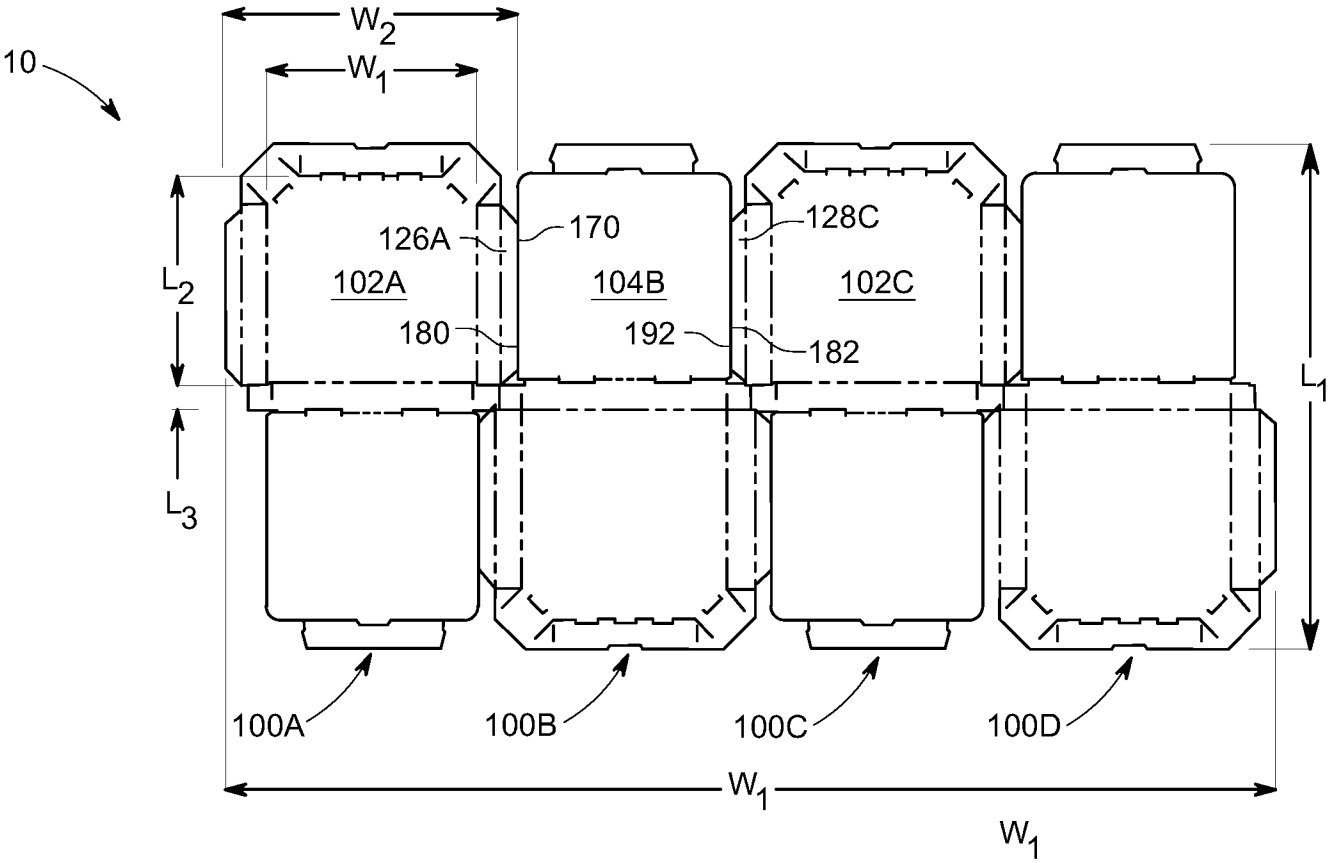
FIG. 2 is a top plan view of a plurality of pizza box blanks illustrated in FIG. 1 assembled in a nesting arrangement.

FIG. 2 illustrates a plurality of blanks 100A-D positioned in a nesting arrangement 10, with blanks 100A and 100C positioned in a first orientation and blanks 100B and 100D positioned in a second orientation, opposite the first orientation. In other embodiments, more or less blanks (e.g., two, three, five, six, seven or more) can be positioned together in a nesting arrangement. For two or more blanks 100 in a nested arrangement, a total width of material needed to form the two or more blanks 100, the material saved can be calculated as $$M = N * W_2 - (N * (2 * W2 - 0.5 * (W2W3)) + (N - 2) * W3)),$$

where M is the linear material saved and N is the number of blanks positioned in a nesting arrangement. In one embodiment, $W_2$ is 17.125 inches and $W_3$ is 12.375 inches. In one embodiment, nesting arrangement 10 can formed through a die cutting machine wherein a cardboard structure is fed into the machine to produce the cuts and seams to form the structures in blank 100.

In the nesting arrangement 10, side edges of the top panels are connected to outer edges of side flaps of adjacent blanks. For example, top panel 104B of blank 100B includes side edges 170 and 172. Side edge 170 is directly connected to outer edge 180 of side flap 126A. In a similar manner, side edge 172 is directly connected to outer edge 182 of side flap 128C.

Figure 3:
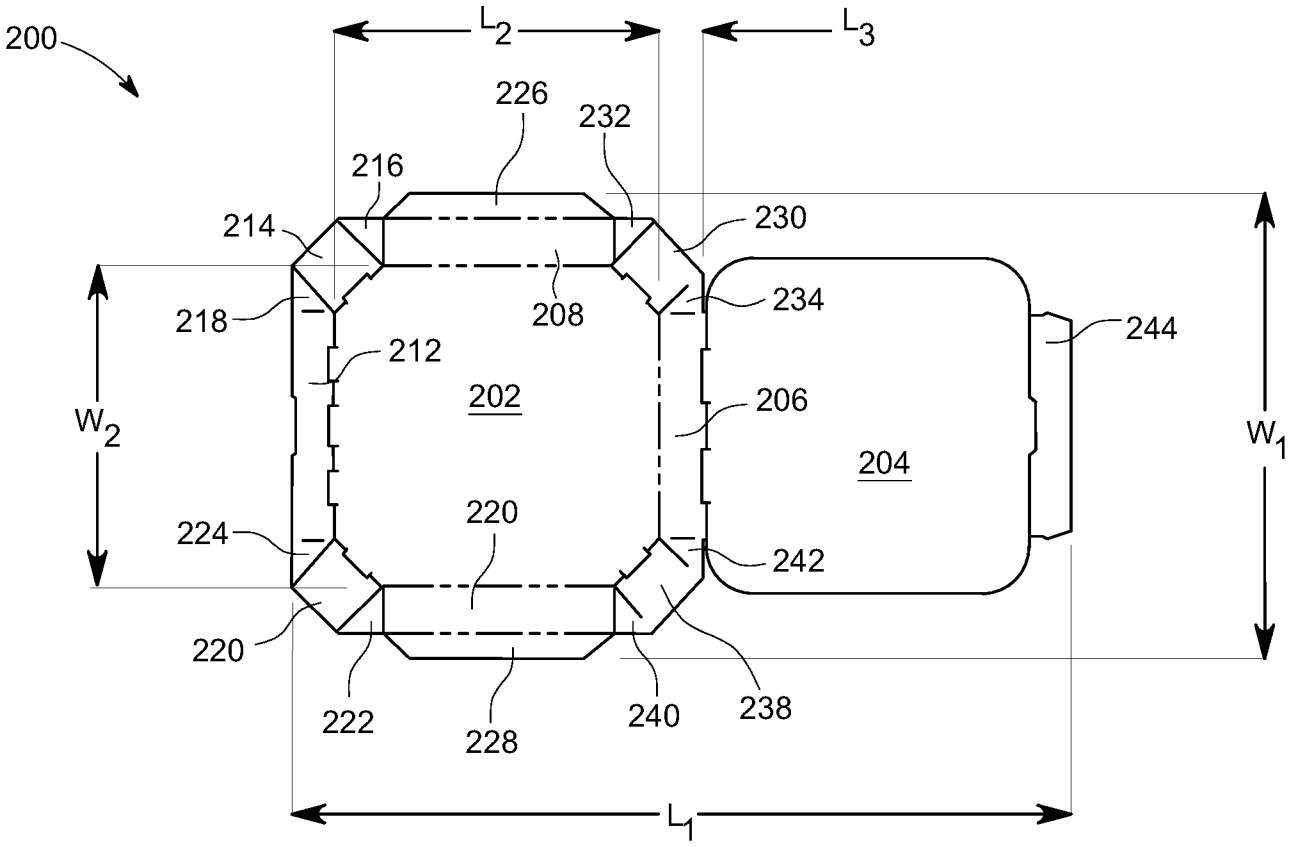
FIG. 3 is a top plan view of a second embodiment of an example pizza box blank.

FIG. 3 is a top plan view of an embodiment of a pizza box blank 200 defining a bottom panel 202, a top panel 204 and a rear wall 206 connecting the bottom panel 202 and the top panel 204. Connected with the bottom panel 202 are opposed side walls 208 and 210, as well as front wall 212. A first corner wall 214 is connected to side wall 208 through a triangular connecting panel 216 and is connected to front wall 212 through a triangular connecting panel 218. Similarly, a second corner wall 220 is connected to side wall 210 through a triangular connecting panel 222 and is connected to front wall 212 through a triangular connecting panel 224. A first side flap 226 is connected to side wall 208 and a second side flap 228 is connected to side wall 210. A third corner wall 230 is connected with side wall 208 through a triangular connecting panel 232 and is connected to rear wall 206 through a triangular connecting panel 234. A fourth corner wall 238 is connected with side wall 210 through a triangular connecting panel 240 and is connected to rear wall 206 through a triangular connecting panel 242. Connected with the top panel 204 is a closure tab 244.

Blank 200 can be assembled into a pizza box by folding top panel 204 toward bottom panel 202. Additionally, each of the side walls 108 and 110 can be folded inwardly, causing front wall 112 to be folded inwardly due to connection of front wall 112 with side walls 108 and 110 through corner walls 114 and 120, respectively. Closure tab 130 can be inserted adjacent front wall 112, the closure tab 130 being positioned between wall 112 and bottom panel 102. When folded into a pizza box, dimension $L_2$ becomes an overall length of the pizza box, dimension $W_2$ becomes an overall width of the pizza box and dimension $L_3$ becomes an overall height of the pizza box. In one embodiment, $W_2$ is 17.625 inches and $W_3$ is 12.375 inches.

Figure 4:
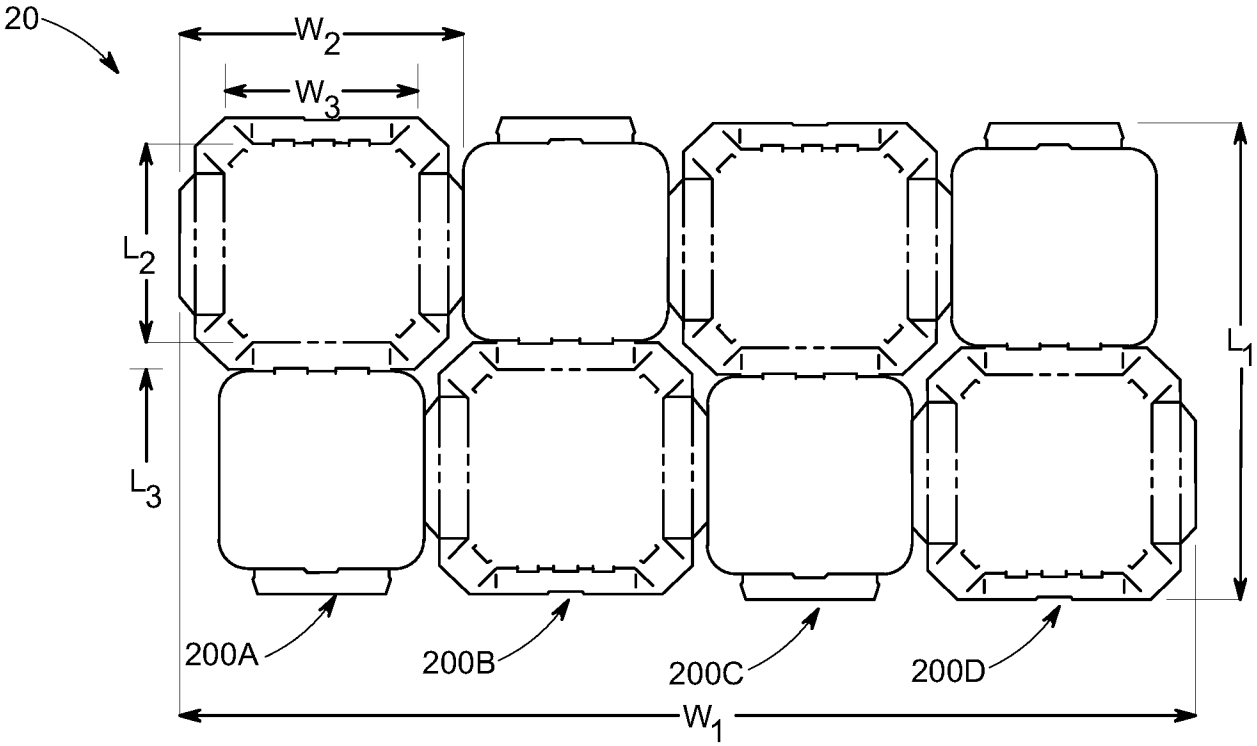
FIG. 4 is a top plan view of a plurality of pizza box blanks illustrated in FIG. 3 assembled in a nesting arrangement.

FIG. 4 illustrates a plurality of blanks 200A-D positioned in a nesting arrangement 20, with blanks 200A and 200C positioned in a first orientation and blanks 200B and 200D positioned in a second orientation, opposite the first orientation. In other embodiments, more or less blanks (e.g., two, three, five, six, seven or more) can be positioned together in a nesting arrangement. For two or more blanks 200 in a nested arrangement, a total width of material needed to form the two or more blanks 200, the material saved can be calculated as $$M = N * W_2 - (N * (2 * W2 - 0.5 * (W2W3)) + (N - 2) * W3)),$$

where M is the linear material saved and N is the number of blanks positioned in a nesting arrangement.

Various embodiments of the invention have been described above for purposes of illustrating the details thereof and to enable one of ordinary skill in the art to make and use the invention. The details and features of the disclosed embodiment[s] are not intended to be limiting, as many variations and modifications will be readily apparent to those of skill in the art. Accordingly, the scope of the present disclosure is intended to be interpreted broadly and to include all variations and modifications coming within the scope and spirit of the appended claims and their legal equivalents.

The invention claimed is:

1. A pizza box blank, comprising:

a bottom panel;

a top panel;

a closure tab connected with the top panel opposite the bottom panel along a first edge;

a rear wall connecting the top panel with the bottom panel, the rear wall connected with the top panel along a second edge, wherein the first edge and second edge are parallel;

a front wall connected to the bottom panel opposite the rear wall;

a first sidewall positioned on a first side of the bottom panel;

a second side wall positioned on a second side of the bottom panel opposite the first side;

a first flap connected to the first side wall and terminating at a third edge opposite said first side wall; and a second flap connected to the second side wall and terminating at a fourth edge opposite said second side wall;

wherein the closure tab includes side edges free from connection to any panel and includes a maximum width along the first edge less than a width of the top panel along the second edge, and further wherein upon assembly of the pizza box blank into a pizza box, said third edge and said fourth edge are orthogonal to said first edge and said second edge.

2. The pizza box blank of claim 1, wherein the rear wall, front wall, first side wall and second side wall, upon assembly of the blank into a pizza box, are of equal height.

3. The pizza box blank of claim 1, wherein in an unassembled state, the top panel includes side edges free from connection to any panel.

4. The pizza box blank of claim 3, wherein the bottom panel is defined by a first width measured from the first side wall to the second side wall and the top panel is defined by a second width from a first side edge to a second side edge, the second width being a maximum width of the top panel and being equal to the first width.

5. The pizza box blank of claim 4, wherein the maximum width of the top panel is the same in both the unassembled state and in an assembled state.

6. The pizza box blank of claim 1, further comprising a third side flap connected to the rear wall and a fourth side flap connected to the rear wall.

7. The pizza box blank of claim 6, wherein the third side flap and the fourth side flap are disconnected from the first side wall and the second side wall, respectively.

8. A nesting arrangement for a plurality of pizza box blanks according to claim 1, comprising:

a first plurality of pizza box blanks oriented in a first direction;

a second plurality of pizza box blanks connected with the first plurality of pizza box blanks and oriented in a second direction, opposite the first direction.

9. A plurality of pizza box blanks positioned in a nesting arrangement, comprising:

a first pizza box blank having a first top panel connected with a first closure tab and a first bottom panel, the first top panel including a first side edge, a second side edge, a first top edge connected with the first closure tab and a first bottom edge parallel with the first top edge, wherein the first bottom panel is connected with a first side wall along a first inner edge and a first flap defining a first outer edge and a second side wall along a second inner edge and a second flap defining a second outer edge, said first inner edge, first outer edge, second inner edge and said second outer edge extending orthogonal to said first top edge and said first bottom edge, and further wherein the first closure tab includes side edges free from connection to any panel and includes a first maximum width along the first top edge less than a first width of the first top panel along the first bottom edge; and a second pizza box blank having a second top panel connected with a second closure tab and a second bottom panel, the second top panel including a third side edge, a fourth side edge, a second top edge connected with the second closure tab and a second bottom edge parallel with the second top edge, wherein the second bottom panel is connected with a third side wall along a third inner edge and a third flap defining a third outer edge and a fourth side wall along a fourth inner edge and a fourth flap defining a fourth outer edge, said third inner edge, third outer edge, fourth inner edge and said fourth outer edge extending orthogonal to said second top edge and said second bottom edge, and further wherein the second closure tab includes side edges free from connection to any panel and includes a second maximum width along the second top edge less than a second width of the second top panel along the second bottom edge, and further wherein the first side edge is connected to the third outer edge and the third side edge is connected to the first outer edge.

10. The plurality of pizza box blanks of claim 9, further comprising a third pizza box blank and a fourth pizza box blank.

11. The plurality of pizza box blanks of claim 9 wherein a distance from the first side edge to the second side edge is less than a distance from the first outer edge to the second outer edge.

12. The plurality of pizza box blanks of claim 9, wherein the first pizza box blank includes a rear wall, a fifth flap and a sixth flap, the fifth flap and the sixth flap connected to opposite sides of the rear wall.

13. The plurality of pizza box blanks of claim 12, wherein the fifth flap and sixth flap are disconnected from the first flap and the second flap, respectively.

14. A method of forming a plurality of pizza box blanks, comprising:

inserting cardboard into a die cutting machine;

forming a first pizza box blank from the cardboard with the die cutting machine, the first pizza box blank having a first top panel connected with a first closure tab and a first bottom panel, the first top panel including a first side edge, a second side edge, a first top edge connected with the first closure tab and a first bottom edge parallel with the first top edge, wherein the first bottom panel is connected with a first side wall along a first inner edge and a first flap defining a first outer edge and a second side wall along a second inner edge and a second flap defining a second outer edge, said first inner edge, first outer edge, second inner edge and said second outer edge extending orthogonal to said first top edge and said first bottom edge, and further wherein the first closure tab includes side edges free from connection to any panel and includes a first maximum width along the first top edge less than a first width of the first top panel along the first bottom edge; and forming a second pizza box blank from the cardboard with the die cutting machine, the second pizza box having a second top panel connected with a second closure tab and a second bottom panel, the second top panel including a third side edge, a fourth side edge, a second top edge connected with the second closure tab and a second bottom edge parallel with the second top edge, wherein the second bottom panel is connected with a third side wall along a third inner edge and a third flap defining a third outer edge and a fourth side wall along a fourth inner edge and a fourth flap defining a fourth outer edge, said third inner edge, third outer edge, fourth inner edge and said fourth outer edge extending orthogonal to said second top edge and said second bottom edge, and further wherein the second closure tab includes side edges free from connection to any panel and includes a second maximum width along the second top edge less than a second width of the second top panel along the second bottom edge, and further, wherein the first side edge is connected to the third outer edge and the third side edge is connected to the first outer edge.

15. The method of claim 14, further comprising forming a third pizza box blank and a fourth pizza box blank.

16. The method of claim 14, wherein a distance from the first side edge to the second side edge is less than a distance from the first outer edge to the second outer edge.

17. The method of claim 14, wherein the first pizza box blank includes a rear wall, a fifth flap and a sixth flap, the fifth flap and the sixth flap connected to opposite sides of the rear wall.

18. The method of claim 17, wherein the fifth flap and sixth flap are disconnected from the first flap and the second flap, respectively.

* * * * *